US009526319B2

(12) United States Patent
Jungling

(10) Patent No.: US 9,526,319 B2
(45) Date of Patent: Dec. 27, 2016

(54) VEHICLE MOUNTED HAMMOCK FRAME

(71) Applicant: David Brian Jungling, Wesley Chapel, FL (US)

(72) Inventor: David Brian Jungling, Wesley Chapel, FL (US)

( * ) Notice: Subject to any disclaimer, the term of this patent is extended or adjusted under 35 U.S.C. 154(b) by 0 days.

(21) Appl. No.: 14/625,605

(22) Filed: Feb. 18, 2015

(65) Prior Publication Data

US 2016/0058197 A1 Mar. 3, 2016

Related U.S. Application Data

(60) Provisional application No. 61/940,888, filed on Feb. 18, 2014.

(51) Int. Cl.
*A47C 17/80* (2006.01)
*A45F 3/24* (2006.01)

(52) U.S. Cl.
CPC ..... *A45F 3/24* (2013.01)

(58) Field of Classification Search
CPC ..... A47C 17/80
USPC ..... 5/120–130
See application file for complete search history.

(56) References Cited

U.S. PATENT DOCUMENTS 5,983,422 A * 11/1999 Bayless ..... A45F 3/24 5/120
7,243,966 B1 * 7/2007 Sheldon ..... B60P 3/40 224/519
9,179,759 B1 * 11/2015 Turner ..... A45F 3/24
2003/0172456 A1 * 9/2003 Jones ..... A47C 23/002 5/200.1

* cited by examiner

*Primary Examiner* — Fredrick Conley
(74) *Attorney, Agent, or Firm* — Jackson Walker LLP

(57) ABSTRACT

The vehicle mounted hammock frame provides for a hammock to be suspended in the bed of a pickup truck approximately 6 feet above ground level. The hammock frame is intended to accommodate several sizes of hammocks including a family sized hammock, which affords comfortable lounging for two adults. The frame is simple to deploy by a single adult in minutes. It is anticipated that all parts may be attached to the unit so that pieces will not be lost or missing when it comes time to deploy the hammock frame. A storage case may be provided for ease of storage and transport. The hammock frame may have members added or attached to it in order that it can be deployed on the ground. Such members might include legs, bracing, and support members configured to allow a user to deploy the hammock frame on the ground.

6 Claims, 17 Drawing Sheets

VEHICLE MOUNTED HAMMOCK FRAME

This application is based upon and claims priority from U.S. Provisional application Ser. No. 61/940,888, which is incorporated herein by reference.

BACKGROUND OF THE INVENTION

Field of the Invention

Applicants' invention relates to a device for suspending a hammock. More particularly, it relates to a hammock frame that is mountable inside a pick-up truck bed.

Background Information

Hammocks are popular around the world for relaxation and sleeping. They can be used for lounging or ads a lightweight bed on camping trips. The hammock conjures an image of leisure and relaxation.

Conventional hammocks are slings, suspended between two (2) or more anchor points, for a person to lie or sit in. The sling portion of the hammock is generally made from a fabric sheet, such as cotton or nylon, or corded netting, often made from nylon, poly, fiber, or cotton. The hammock may be used for swinging, sleeping, or resting.

The hammock sling normally consists of one or more cloth panels, or a woven network of twine or thin rope. This creates a sheet, albeit a sheet that may have holes, on which a person may lie.

The anchor points need to be an appropriate distance apart—close enough to tie the ends of the hammock (or cables tied to the ends of the hammock) to, but far enough apart to allow the user to rest between. Because the hammock will need to support the weight of the user (or sometimes multiple users), the sling portion and the tie straps must be of sufficient tear resistance to accommodate such a load. Additionally, with the hammock hanging from the anchor points, the anchor points must also be sufficiently strong to support the user's weight.

The anchor points are generally either existing structures—whether made-made such as posts or walls, or natural such as trees—or frames that stand alone with two end-points for attaching to the hammock ends or tie straps.

There are a wide variety of hammocks available, as well as accessories for them. There are light-weight, packable hammocks that are designed specifically for backpacking that may include rain flys, mosquito netting, or storage pockets. There are hammocks made for placement in the user's yard or beach that are purely for relaxation.

Hammocks come in a variety of colors, patterns, and sizes ranging from holding one person to two or three persons. There are even hammocks intended to take the place of a tent. Common dimensions for unslung hammocks fall in a range between 3'/0.9 m to 14'/4.2 m across and 6'/1.8 m to 11'/3.3 m long.

One of the many hammock styles is framed, sometimes called a spreader-bar style. The spreader-bar hammock is easily recognized by wooden or metal bars at the head and foot of the hammock, spreading its width and allowing for easy access for casual use, such as in a backyard. Some framed hammocks may have a single-spreader bar, which uses a spreader bar on only one end and is much more stable. A variation of the single-spreader bar hammock has three attachment points, one at each corner of the spreader bar and one at the non-spreader bar end and is nearly untippable.

Various styles of hammocks available have different materials or construction. Some may be made of cotton or nylon string that is woven to form a net. A solid fabric may be used, which tends to be more durable than the string varieties. Camping hammocks are generally made of nylon or polyester.

Camping hammocks may have a ridgeline, which is generally in line strung between each end and above the hammock, from which additional gear, such as mosquito netting and rain flys are hung.

For non-spreader-bar styles, the way in which hammocks are hung is critical for comfort. Generally, a higher attachment point is preferred as well as sufficient length between attachment points, though these two dimensions can be adjusted to compensate for a lack in one or the other. The optimal angle of the attaching lines to the post/wall/tree is usually about 30 degrees.

Though one can lie in a hammock lengthwise or across its width, most hammocks are best used with a diagonal position, as it provides the most room and support. Users with back and joint pains often report some relief from these problems when sleeping in a hammock in this manner.

One favorite use for hammocks is for rest and relaxation at recreational events. The problem, is that often appropriate anchor points are not available. This could be because there are a great number of people at such events which limits the availability of anchor points, or room to locate a hammock. Or, in an area such as maybe a metropolitan or beach location, there may not be appropriate anchors regardless of the number of people. Another problem may be that in some areas, such as a parking lot tailgate party, there is simply no room for setting up a hammock. Another problem is that conventional hammocks frames are rather large and difficult to transport.

SUMMARY OF THE INVENTION

The present invention is the truck mounted hammock frame. It was developed as an accessory for recreational relaxation. With a hammock suspended in the bed of a pickup truck approximately 6 feet above ground level, views are unimpeded and scenic locations are endless so long as the truck can drive to it. The present truck mounted hammock frame is intended to be designed in order that it can accommodate several sizes of hammocks including a family sized hammock (on the order of 7'×5'), which affords comfortable lounging for two adults.

Designed with ease of use in mind, the current invention is simple to deploy by a single adult in minutes. The parts are manufactured to be sturdy and simple to assemble. It is anticipated that all parts may be attached to the unit so that pieces will not be lost or missing when it comes time to deploy the truck mounted hammock frame. A storage case may be provided for ease of storage and transport.

The positioning and visibility of the truck mounted hammock frame and hammock makes a chosen location easy to see. The hammock sling, or bed, can also provide an extremely visible location for a favorite team logo or promotional print. The uprights of the truck mounted hammock frame provide an ideal location for flags, pennants, kites, or other markers.

The truck mounted hammock frame is ideal for tailgating at sporting events, camping, or relaxing at rest areas, beaches and parks. Offering a mobile platform for a hammock negates the problem of looking for perfectly spaced trees or hauling cumbersome ground frames to a chosen location.

It is also anticipated that the hammock frame may have members added or attached to it in order that it can be deployed on the ground. Such members might include legs, bracing, and support members configured to allow a user to deploy the hammock frame on the ground.

Some important characteristics of the truck mounted hammock frame are anticipated to include, without limitation, the following:

built to support two occupants, and designed to utilize a "family sized" hammock;

360 view above the cab of the truck;

telescoping deployment of the supports;

mounting to the pickup bed rails;

collapsible design and carry case system; and all the other obvious features from the drawing.

DETAILED DESCRIPTION OF THE PREFERRED EMBODIMENT

Figure 1:
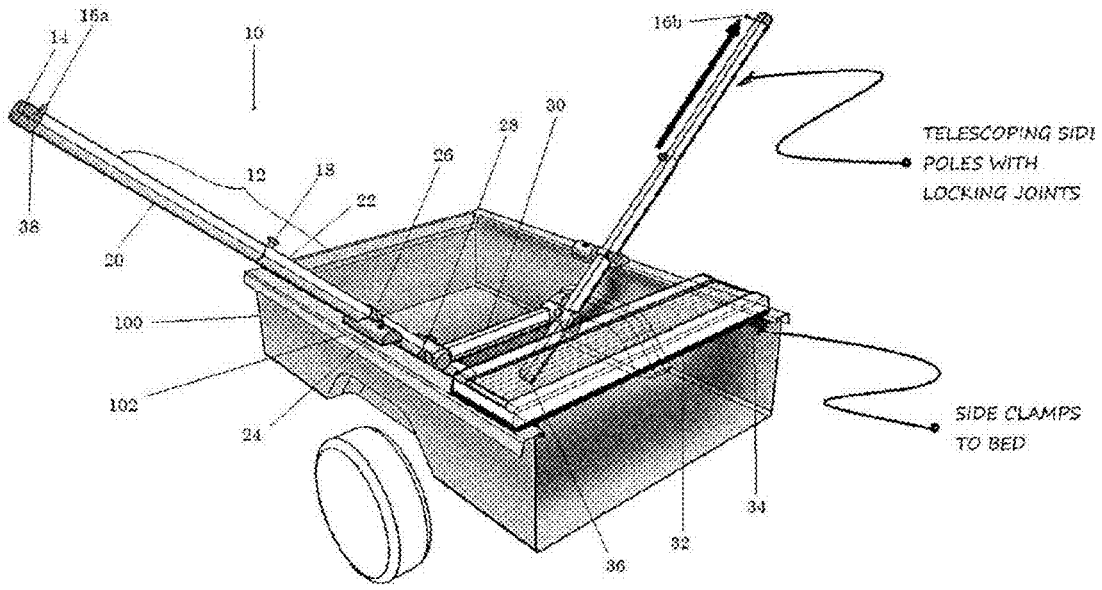
FIG. 1 is a perspective view of a deployed truck mounted hammock frame mounted in the cutaway of a pickup bed.

Referring to the figures, FIG. 1 illustrates a perspective view of a deployed automobile, bed mounted hammock frame 10 mounted in the cutaway of a pickup bed 100. The hammock frame 10 for a hammock (not shown) which is supported by a U-shaped frame 10 mounted on a base member 30. It is anticipated that the base member 30 may consist one or multiple base members 30 oriented generally in line with the U-shaped frame 10. The base member 30 has a first end and a second end. The hammock stand 10 is comprised of one or more brace members 30 rotatably attached at their ends to two side poles, a first and a second, 12 of the hammock frame 10. The frame 10 may be fixed to a vehicle surface, anticipated to be the bed of a pickup truck however other locations on other vehicles are also anticipated in the use of this invention. The brace member 30 may be made of any sufficiently supportive material, such as tube steel, other metal, or plastic. It may be attached in the pickup bed 100 or to the vehicle surface by welding, clamping, fasteners, adhesives, weight friction, or other methods known in the art.

The hammock stand 10 provides a means of mounting a hammock (not shown) supported by a U-shaped frame 10 onto a vehicle, such as a truck, car, or boat. The hammock stand 10 is held together by a brace member 30. At the brace member's 30 first end 30*a*, and the opposite second end 30*b*, brace connectors 20 are connected to the brace member 30. Also connected to the brace connector 28 are the side poles 12. The side poles 12 are rotatably connected to the brace member 30 via the brace connector 28. Thus, it is anticipated that the brace connector 28 will have two parts, the first connecting to the side pole 12 and the second connecting to the brace member 30. The first and second brace connector 28 parts are connected via a connector that allows for rotation.

The side poles 12 are comprised of one or more pieces. In a first embodiment, the side pole 12 is comprised of a side pole base member 22 and a side pole extension member 20. The side poles 12 are hollow tubes with either circular, ovoid, or polygonal shaped outer walls. It is anticipated that the side pole extension member 20 will be sized to fit inside the side pole base member 22 allowing the side pole extension member 20 to slide in and out, or telescope, of the side pole base member 22. The pole butt 36 is at one end of the side pole base member 22. The pole butt 36 rests on the hammock frame 10 substrate—such as the pickup bed. The side pole 12 is attached to the truck bed rail 102 by a pole bed rail clamp 24. The pole bed rail clamp 24 is attachable and detachable from the truck bed rail 102 without damaging either the pole bed rail clamp 24 or the truck bed rail 102. The pole bed rail clamp 24 has a connector, anticipated to be a channel through which the side pole 12 runs, connecting the side poles 12 to the pole bed rail clamp 24.

In a first embodiment, the side poles 12 are comprised of two sub-poles—the side pole extension member 20 and the side pole base member 22. The side pole extension member 20 slides in and out of the side pole base member 22. At the end of the side pole base member 22 opposite the pole butt 36 is a lock 18. When engaged, the lock 18 retains the side pole extension member 20 in place in the side pole base member 22. When disengaged, the lock 18 allows the side pole extension member 20 to slide in and out of the side pole base member 22. Thus, when the user wishes to deploy the frame 10, the user extends the side pole extension member 20 and engages the lock 18 so that the side pole extension member 20 is held in an extended position from which the hammock (not shown) can be attached and deployed. The pole extension end 38 of the side pole extension member 20 opposite the side pole base member 22 may be closed with a pole cap 14 attached. An anchor point 16 is connected to the second end 12*a* of the side pole extension member 20. The anchor point 16 is provided to allow for attachment of the hammock (not shown).

A device for raising and lowering the hammock (not shown) may be attached to one of the side poles 12. It is anticipated that the raising device (not shown) may be a type of winch with a strap. The running end of the strap (not shown) will connect to the hammock (not shown).

An accessory piece 32 has multiple functions, such as a carrying case for the pieces of the frame 10, or as a step or ramp to allow the user to more easily enter and exit the hammock. The accessory piece 32 is attached at either end to the truck bed 100. Generally, the attachment will be to the bed rails 102. The accessory piece 32 is attached to the bed rails 102 via an accessory piece clamp 34.

Sufficiently heavy material may be used in the space directly under the hammock to provide ease in climbing into the hammock and effectively shortening the fall distance should the hammock fail. It can also be used as a shelf to hold the user's personal items while in the hammock.

Figure 2:
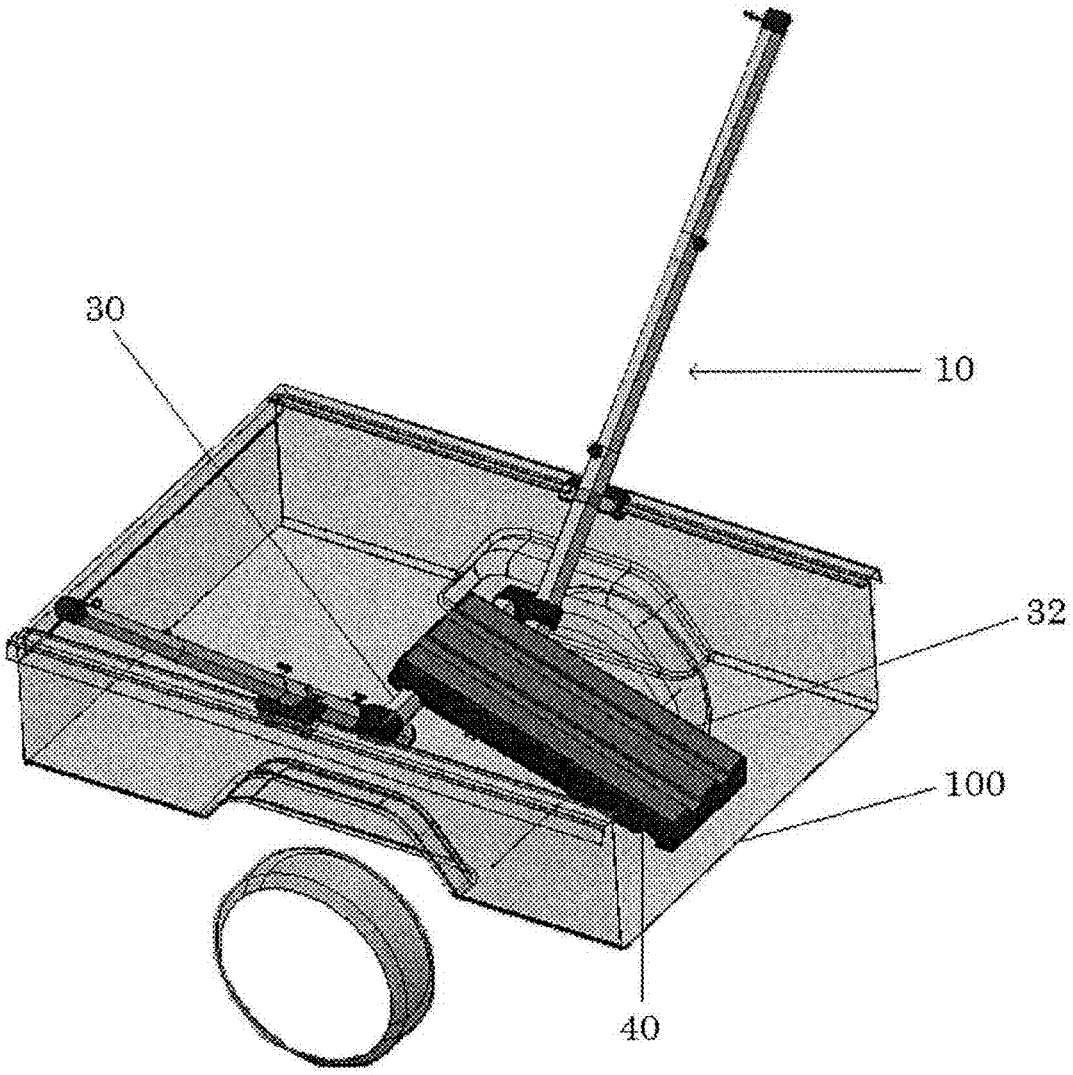
FIG. 2 is a perspective view of the truck mounted hammock frame mounted in the cutaway of a pickup bed with the accessory piece deployed as a ramp.
Figure 4:
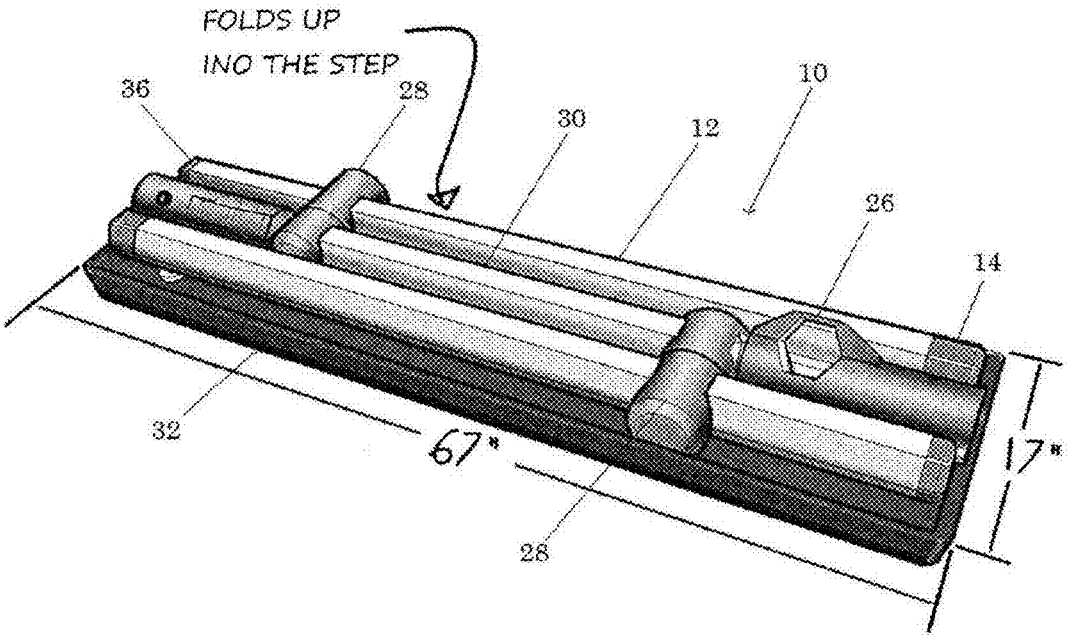
FIG. 4 is a perspective view of a stowed truck mounted hammock frame.

FIG. 2 shows the truck mounted hammock frame 10 mounted in the cutaway of a pickup bed 100 with the accessory piece 32 deployed as a ramp. As shown in FIG. 4, the accessory piece 32 may be used as a storage case for the component parts of the frame 10. Once the frame 10 is removed from the accessory piece 32 and deployed, the accessory piece 32 may be made use of as either a step or ramp. In order that the accessory piece 32, when used as a ramp, may be engaged with the brace member 30, the accessory piece 32 may have cutouts 40 in the walls of the accessory piece 32. The cutouts 40 are sized and shaped in order to accept and engage the brace member 30. Thus, as a user enters the pickup bed 100 the user can walk up the ramp 32, or step up on step 32 (as shown deployed in FIG. 1) in order to more easily enter or exit the hammock.

Figure 3:
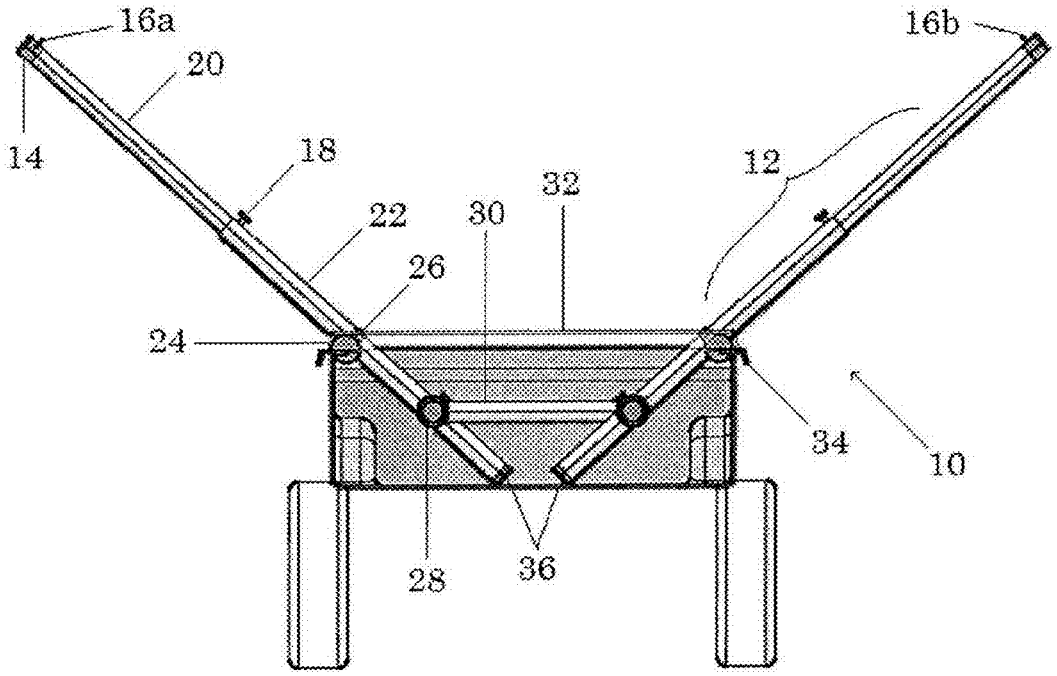
FIG. 3 is a front view of the truck mounted hammock frame mounted in the cutaway of a pickup bed.

FIG. 3 is a front view of the truck mounted hammock frame mounted in the cutaway of a pickup bed. This figure more clearly illustrates the relationship of the brace member 30 and the side pole base members 22. The brace connectors 28 and the pole bed rail clamps 24 effectively lock the frame 10 into position. The frame 10 is further kept from moving due to weight pressing down on the pole butts 36 against the truck bed 100 (or other substrate). This figure also shows how the side poles 12 are telescopic with the side pole extension members 20 extendable from the side pole base members 22, and held in place by the lock 18. The hammock (not shown) is deployed between the anchor points 16*a* and 16*b*. The accessory piece 32 is also shown in this figure in place.

FIG. 4 is a perspective view of a stowed truck mounted hammock frame. In certain embodiments, the hammock stand 10 is collapsible for convenient transportation and storage. It is anticipated that the accessory piece 32 may act as a storage case for the remainder of the frame 10. As described above the brace connectors 28 are rotatable which allows for deployment as well as allowing for folding the frame 10 into a more compact structure. As shown in this figure, the side poles 12 and brace member 30 have been folded to lie side-by-side in a generally flat manner and urged into the accessory piece 32. Connectors (not shown) in the accessory piece 32 can hold the remainder of the frame 10 against the accessory piece 32. In this figure and embodiment, the side poles 12 and brace member 30 are illustrated as hexagons. As noted above, the side poles 12 and brace member 30 may have a number of shapes.

Figure 5:
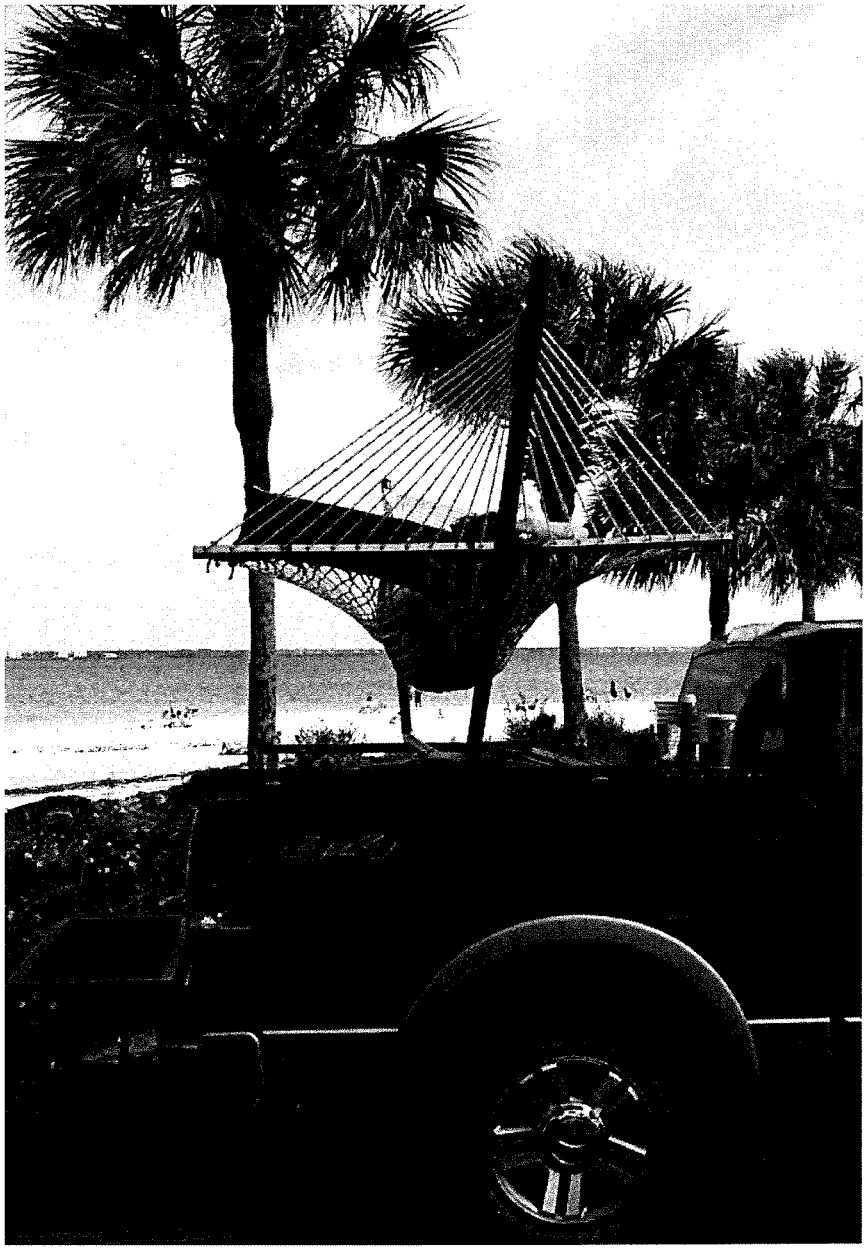
FIG. 5 is a side, perspective view of a deployed truck mounted hammock frame mounted in a pickup bed.

FIG. 5 is a side, perspective view of a deployed truck mounted hammock frame mounted in a pickup bed. A hammock has been attached to the frame 10 at the anchor points 16, and a user is lying in the hammock. As is shown, the frame 10 raises the hammock relatively high off the ground in the back of the pickup bed 100.

Figure 6:
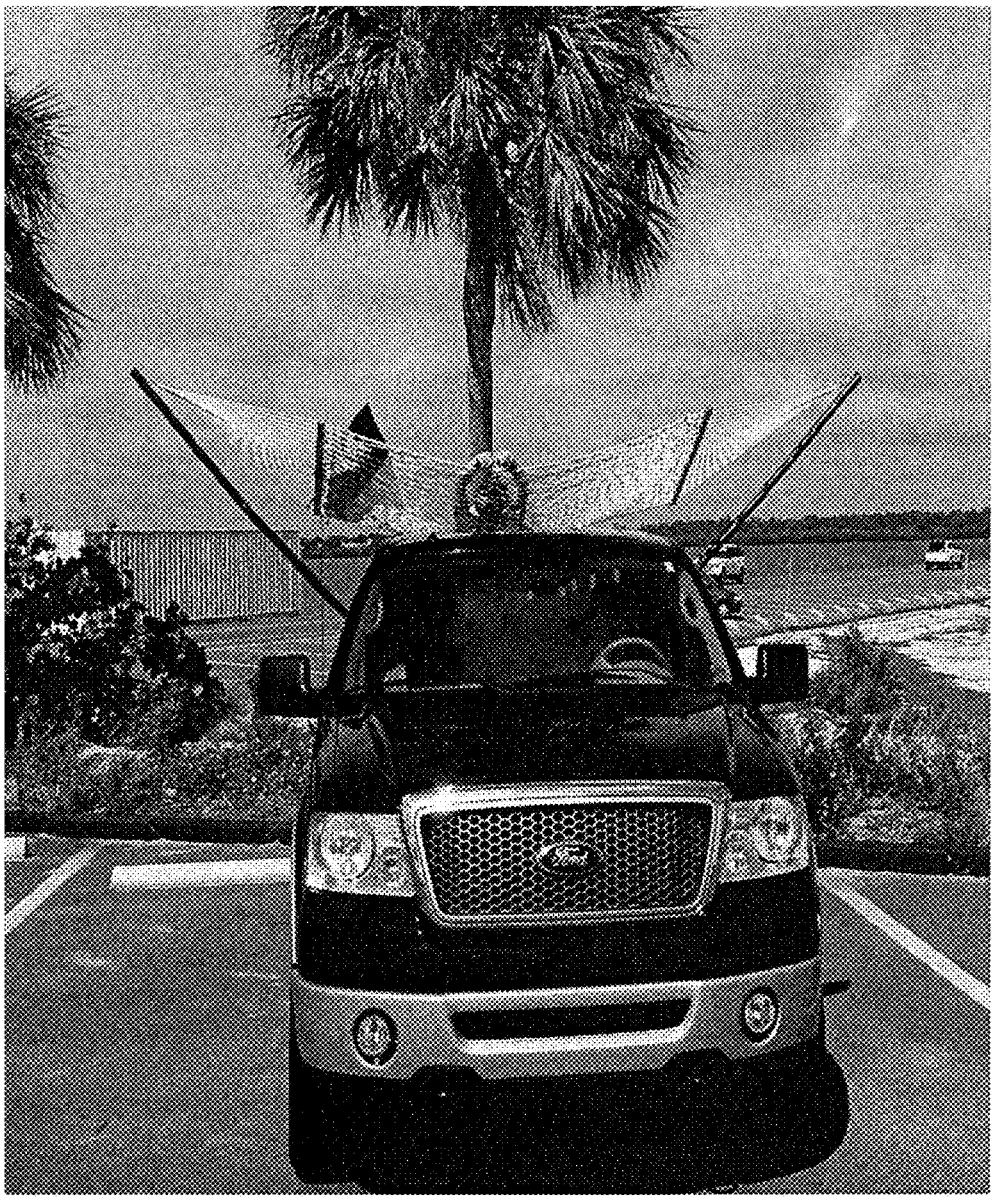
FIG. 6 is a front, perspective view of a deployed truck mounted hammock frame mounted in a pickup bed.

FIG. 6 is a front, perspective view of a deployed truck mounted hammock frame mounted in a pickup bed. Again, the frame 10 is shown deployed in a pickup bed 100 with a hammock mounted and a user in the hammock.

Figure 7:
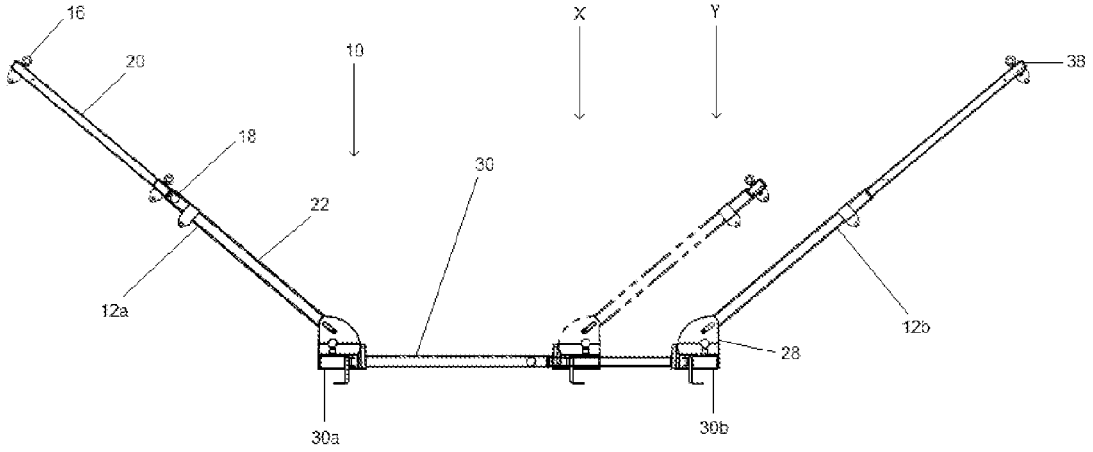
FIG. 7 is a front view of a second embodiment of the truck mounted hammock frame.

FIG. 7 is a front view of a second embodiment of the truck mounted hammock frame 10. The brace member 30 has a first end 30*a* and a second end 30*b*. Attached to the base member 30 at each end is a brace connector 28. The brace member 30 may be telescoping and being movable from a first position X to a second position Y in order to fit in different size vehicles. The pole member 12 is made up of a side pole ace member 22 and a side pole extension member 20.

Figure 8:
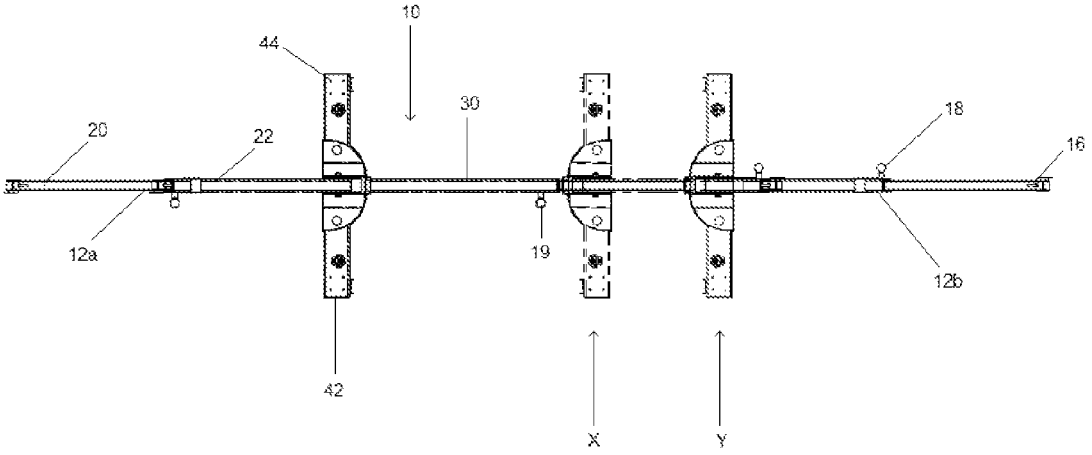
FIG. 8 is a top view of the truck mounted hammock frame.

FIG. 8 is a top view of the truck mounted hammock frame 10. This figure shows the stabilizing legs 42 that are extendable from the base member 30. The stabilizing legs 42 rotate outwardly when the truck mounted hammock frame 10 is deployed in order to lessen the chance of the frame 10 falling the side. Again in this figure the extension of the base member 30 is shown with the frame 10 being shown any first position X, and a second position Y.

Figure 9:
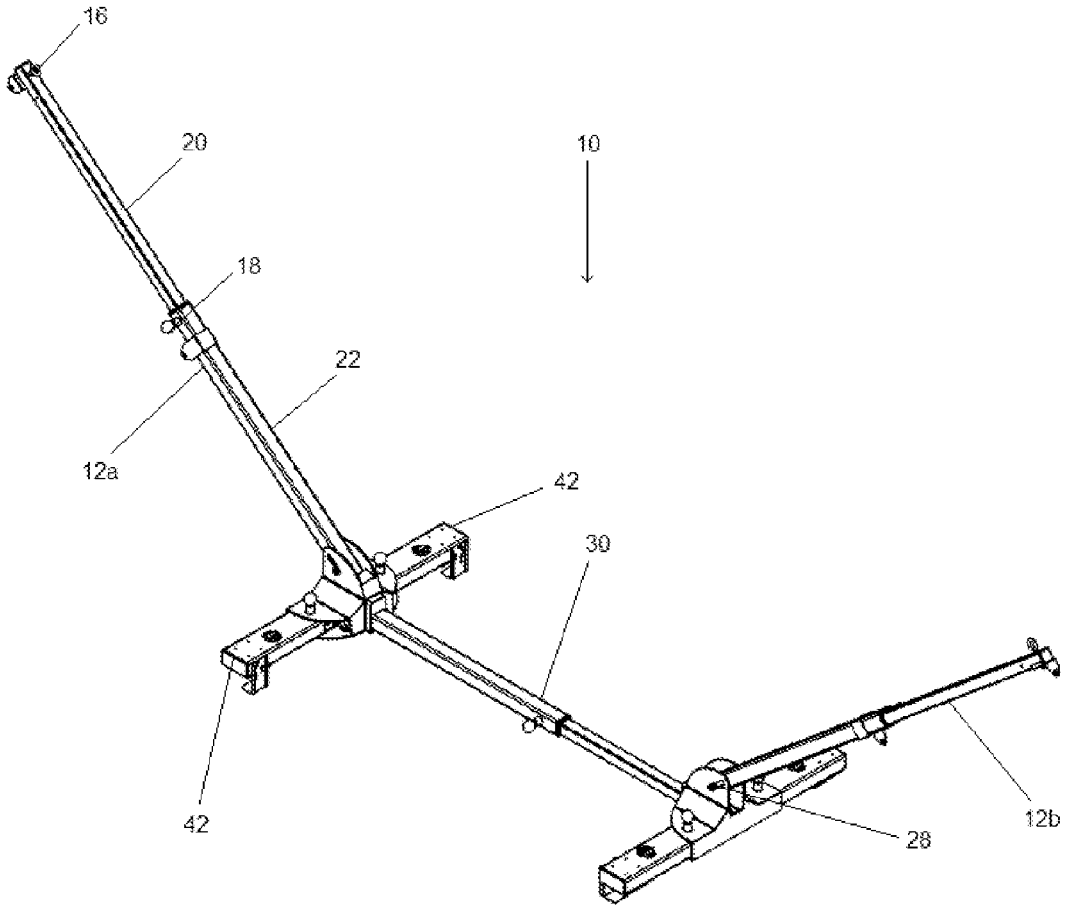
FIG. 9 is a perspective view of the second embodiment of the truck mounted hammock frame.

FIG. 9 is a perspective view of the second embodiment of the frame 10 as it is deployed with the stabilizing legs 42 extended perpendicularly from the base member 30. The pole members 12 extend from the end of the base member 30. The pole members 12 extend generally upwardly at an angle in order to create the distance needed for a hammock to be suspended between the anchor points 16.

Figure 10:
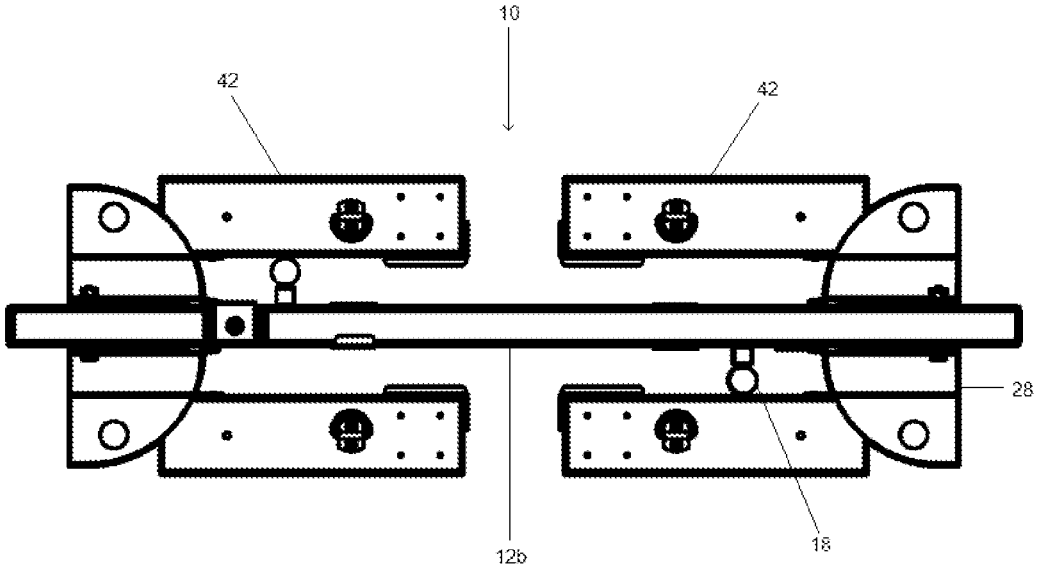
FIG. 10 is a top view of the frame in the folded position.

FIG. 10 is a top view of the frame 10 and illustrates it in the folded position with the poles 12 folded down generally parallel and adjacent to the base member 30. Additionally the stabilizing members 42 have been rotated into their non-deployed position.

Figure 11:
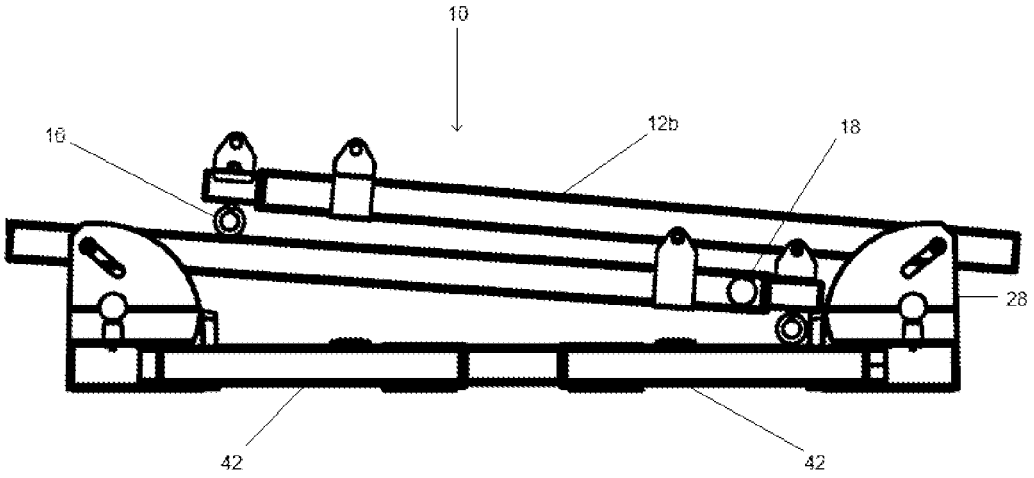
FIG. 11 is a side view of the frame in the folded position.

FIG. 11 is a side view of the frame 10 and illustrates it in the folded position with the poles 12 folded down generally parallel and adjacent to the base member 30. Additionally the stabilizing members 42 have been rotated into their non-deployed position.

Figure 12A:
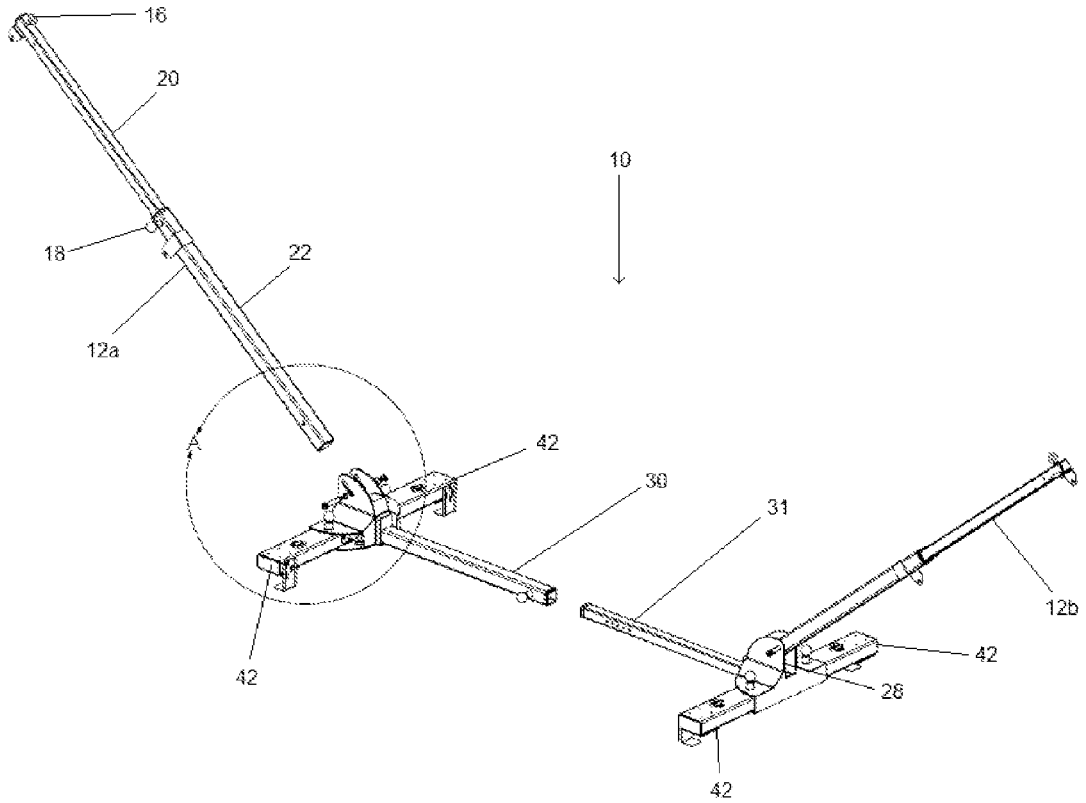
FIG. 12*a* is an exploded illustration of the frame.
Figure 12B:
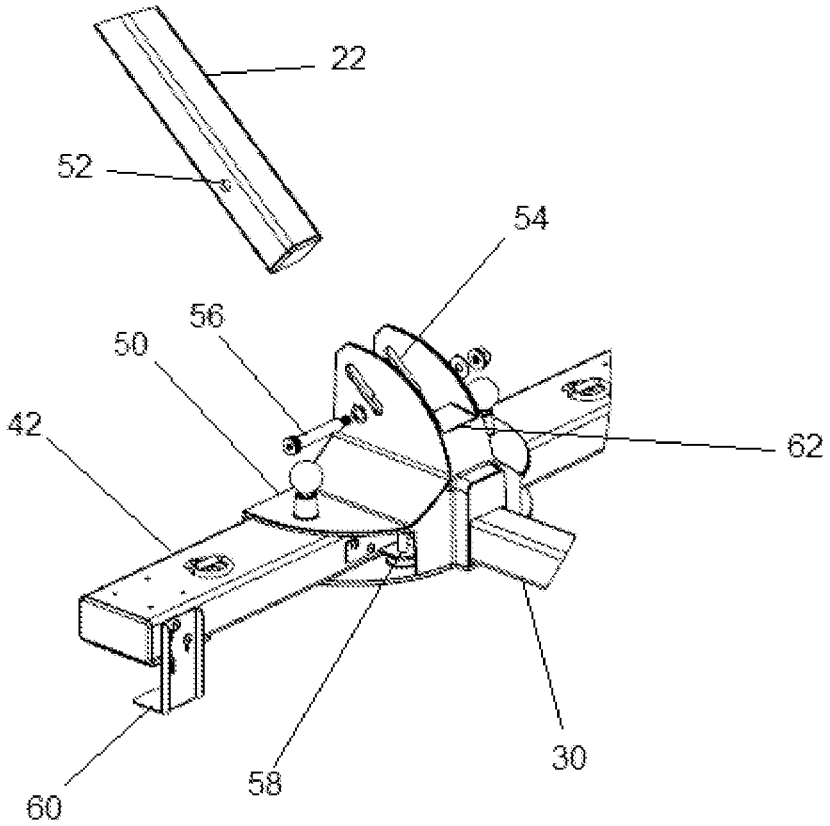
FIG. 12*b* is a close up view of area A in FIG. 12*a*.
Figure 13A:
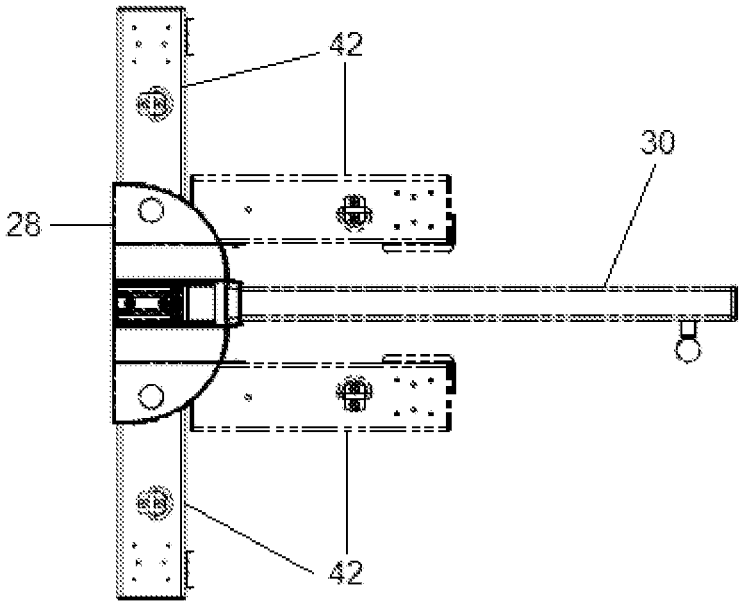
FIG. 13*a* is a top view of the base portion of the frame illustrating the extended and folded positions of the stabilizers.
Figure 13B:
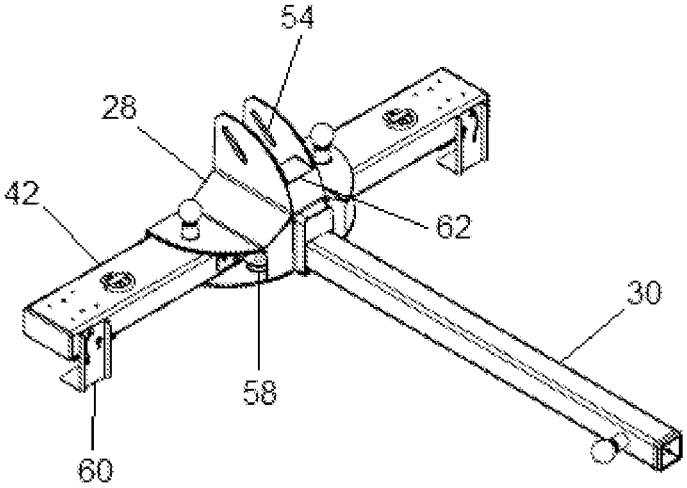
FIG. 13*b* is a perspective view of the base portion of the frame illustrating the stabilizers in the deployed or extended position.
Figure 13C:
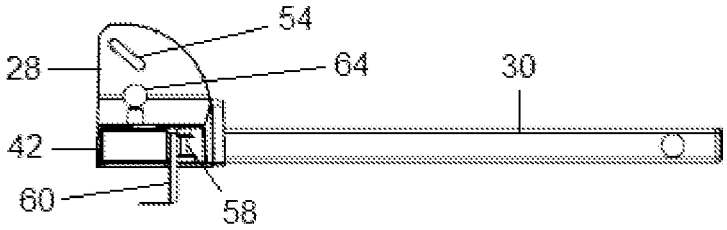
FIG. 13*c* is a side view of the base portion of the frame illustrating the stabilizers in the deployed or extended position.
Figure 13D:
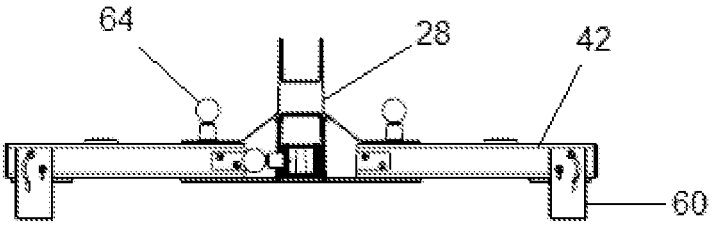
FIG. 13*d* is a front view of the base portion of the frame illustrating the stabilizers in the deployed or extended position.

FIG. 12*a* is an exploded illustration of the frame 10. FIG. 12*b* is a close up view of brace connector 28 in area A as shown in FIG. 12*a*. The base member 30 connects to the base connector 28. The base connector 28 allows the pole 12 to rotate from a deployed position to a storage position. In one embodiment, the pole 12 attaches to the brace connector 28 by an axle 56 inserted through a slot 54 in the brace connector 28 and through an aperture 52 in the pole 12. In the deployed position, the pole 12 extends generally upwardly at an angle and rest against a pole butt 62. In order to fold the frame 10, the poles 12 are lifted away from the pole butt 62 and rotated about the axle 56 thereby laying down against the pole butt 62 (as shown in FIG. 11). The brace connector 28 has stabilizer connection 50 into which the stabilizers 42 are inserted connected. Connections 58 of the stabilizers allow for the rotation of the stabilizers 42 from a deployed position to a storage position. The stabilizers 42 may have feet 60 that may be raised and lowered in order to level the frame 10.

FIGS. 13*a*, 13*b*, 13*c*, and 13*d* illustrate various positions of the base member 30 and stabilizers 42.

Figure 14:
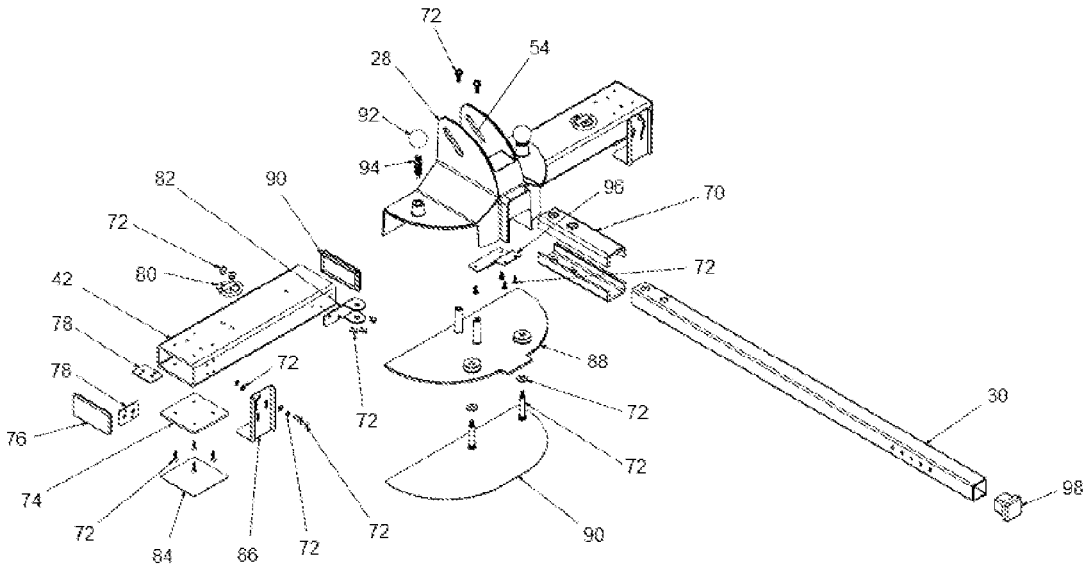
FIG. 14 is a blowup of the base member, brace connector, and stabilizers of the frame.

FIG. 14 is a blowup of the base member 30, brace connector 28 and stabilizers 42. The brace member 30 may have a connection collar 70 that allows it to be connected to the brace connector 28. Various connectors 72 are used to attach the pieces of the base member 30, brace connector 28, and stabilizers 42 together. The same fashion the leveling feet 60 are put together and attached to the stabilizers 42. The leveling feet 60 may have extenders 86 and base plates 74. The stabilizer 42 can have a template 76 opposite the brace connector 28. The stabilizer 42 also have a template 90 inserted into the brace connector 28. The brace connector 28 is attached to the stabilizer 42 with a rotatable connector 58.

Figure 15:
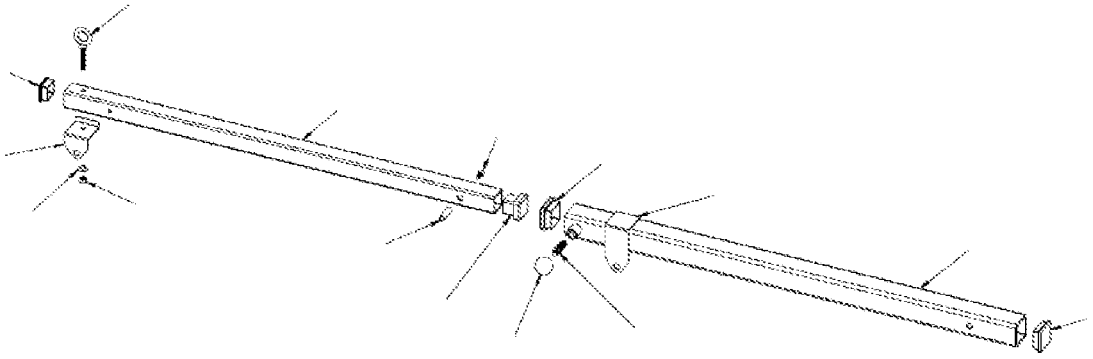
FIG. 15 is a blowup of the pole.

FIG. 15 is a blowup of the pole 12. Eyelets 16 allow for the attachment of a hammock. It is anticipated that the extension pole 20 will insert into base pole 22 and telescopically extend outwardly in order to deploy. The extension pole 20 may have and caps and the baseball 22 may have an insertion. A fixed flag bracket may be attached to the extension pole 20, while a slidable flag bracket may be attached along the length of the pole 12. It is anticipated that springs or other elastomers (not shown) may be inside base pole 22 in order to assist with the extension of extension pole 20. Although shown in this embodiment as a telescopic pole 12, it is anticipated that the base pole 22 and the extension pole 20 may be hinged at their connection in order to allow the pole 12 to extend to its deployed position or to be folded against each other in the storage position.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A hammock frame for holding a hammock and deploying in a bed of a vehicle comprising:

a base member having a first end and a second end, sized to fit inside said bed;

a first pole rotatably attached to said first end of said base member;

a second pole rotatably attached to said second end of said base member;

wherein said first and second poles are telescoping;

wherein said first and second poles have a connector at an end opposite said base member for connection to said hammock; and wherein said first and second poles may be folded generally parallel and adjacent to said base member in a storage position or extended generally outwardly at an angle from said base member in a deployed position.

2. The apparatus of claim 1, further comprising:

a brace connector into which said base member and said pole is attached, said brace connector having an axis about which said pole rotatable.

3. The apparatus of claim 2, further comprising a multiplicity of stabilizers rotatably attached to said brace connector.

4. The apparatus of claim 1, further comprising:

wherein said pole is comprised of a side pole base member and a side pole extension member; and wherein said side pole extension member is slidably attached inside of said side pole base member such that it can telescope outwardly.

5. The apparatus of claim 4, further comprising a spring or elastomer inside of said side pole base member wherein said spray spring or elastomer assists the extension of said side pole extension member.

6. The apparatus of claim 1, wherein said base member may be expandable to fit varying sizes of said vehicle.

* * * * *